US009462391B2

(12) United States Patent
Johnston et al.

(10) Patent No.: US 9,462,391 B2
(45) Date of Patent: Oct. 4, 2016

(54) VERTICALLY AND HORIZONTALLY BALANCED SUBWOOFER

(71) Applicants: Robert G. Johnston, Amprior Ontario (CA); Sanford M. Gross, Owings Mills, MD (US)

(72) Inventors: Robert G. Johnston, Amprior Ontario (CA); Sanford M. Gross, Owings Mills, MD (US)

( * ) Notice: Subject to any disclaimer, the term of this patent is extended or adjusted under 35 U.S.C. 154(b) by 0 days.

(21) Appl. No.: 14/862,359

(22) Filed: Sep. 23, 2015

(65) Prior Publication Data

US 2016/0094909 A1 Mar. 31, 2016

Related U.S. Application Data

(60) Provisional application No. 62/055,012, filed on Sep. 25, 2014.

(51) Int. Cl.
*H04R 9/06* (2006.01)
*H04R 1/28* (2006.01)
*H04R 1/40* (2006.01)

(52) U.S. Cl.
CPC ..... *H04R 9/063* (2013.01); *H04R 1/2834* (2013.01); *H04R 1/403* (2013.01)

(58) Field of Classification Search
CPC ..... H04R 1/00; H04R 2205/022; H04R 2201/401; H04R 2201/405; H04R 2201/34; H04R 1/2815–1/2826
USPC ..... 381/345–346, 348–349, 182
See application file for complete search history.

(56) References Cited

U.S. PATENT DOCUMENTS 5,850,460 A * 12/1998 Tanaka ..... H04R 1/2873 381/182
6,626,263 B2 * 9/2003 Sahyoun ..... H04R 1/2834 381/349
6,704,426 B2 * 3/2004 Croft, III ..... H04R 1/2842 381/349

(Continued)

OTHER PUBLICATIONS

SVS; Musical TNT: Small Packages, Huge Impact; http://www.svsound.com/subwoofers/sealed-box; 12 pages; Youngstown, Ohio; unknown publication date but admitted prior art.

(Continued)

*Primary Examiner* — Suhan Ni
(74) *Attorney, Agent, or Firm* — www.bobharter.com; Robert J. Harter

(57) ABSTRACT

A speaker system, particularly useful as a subwoofer, comprises an enclosure with one acoustic transducer facing to the right and one acoustic transducer facing to the left, which effectively cancels out transducer cone mass induced vibration within the enclosure. The enclosure also has one passive radiator facing up and one passive radiator facing down. The passive radiator facing down effectively couples acoustic energy at very low frequencies into the floor. The passive radiators each have a rather a large area and high mass. The large, high mass, bottom mounted passive radiator will produce large amounts of enclosure vibration, and so to cancel this vibration, the upper passive radiator is of substantially the same mass and size. The resulting system will be vibrationally balanced on all axes while simultaneously effectively coupling low frequency energy onto the floor of the listening room with good efficiency.

16 Claims, 4 Drawing Sheets

(56) References Cited

U.S. PATENT DOCUMENTS

| | | | | |
|---|---|---|---|---|
| 7,133,533 | B2 * | 11/2006 | Chick | H04R 1/2834 381/349 |
| D678,243 | S | 3/2013 | McManigal et al. | |
| 8,842,868 | B1 * | 9/2014 | Hsu Huang | H04R 1/2834 381/345 |

OTHER PUBLICATIONS

Paradigm; Sub-1; http://www.paradigm.com/products-current/model=sub-1/page=overview; Paradigm Electronics Inc.; Mississauga, Canada; unknown publication date but admitted prior art.

Martinlogan; Balanced Force Subwoofers ; Lawrence, Kansas; website; https://www.martinlogan.com/balancedforce/; 18 pages; unknown publication date but admitted prior art.

Supercube 4000; Definitive Technology; website; http://www.definitivetech.com/products/supercube-4000; 19 pages; Owings Mills, Maryland; unknown publication date but admitted prior art.

BP-8060ST; Definitive Technology; website; http://www.definitivetech.com/products/bp-8060st; 14 pages; Owings Mills, Maryland; unknown publication date but admitted prior art.

* cited by examiner

System Coupling Coefficient $$SCC = \left\{ 1 - \left[ \frac{1}{\sqrt{\frac{Me^2}{Mpt^2} \times \left( \frac{Apt \times Sdt}{Aa} \right)^{1/3}}} \right] \right\} \times \frac{p}{c}$$

72 SCC; 104 102 78 82 84 102 104 110 p c 106 108 74 80 85 98 100

FIG. 5

Area Coefficient $$AC = \frac{Apt \times Aa}{Sdt^2}$$

112 AC; 114 82 85 Apt Aa; 116 84 Sdt

FIG. 6

Mass Coefficient $$MC = \frac{Me}{Mmd \times Mpt}$$

118 MC; 78 120 Me; 76 122 74 Mmd Mpt

FIG. 7

VERTICALLY AND HORIZONTALLY BALANCED SUBWOOFER

CROSS REFERENCE TO RELATED APPLICATIONS

This application claims the benefit of provisional patent application Ser. No. 62/055,012 filed on Sep. 25, 2014 by the first co-inventor and is specifically incorporated herein by reference.

FIELD OF THE DISCLOSURE

The subject invention generally pertains to loudspeaker systems and more specifically to subwoofers.

BACKGROUND

In its most basic form, a subwoofer is simply a low frequency acoustic transducer enclosed within a sealed box. Although there have been a number of techniques employed to couple the very low frequency ranges into the surrounding environment in order to excite the room and provide a satisfying listening experience at low frequencies, compromise is often accepted due to low system efficiency, unwanted vibrations in the enclosure, and poor coupling to the listening room floor at very low frequencies.

In attempts to improve on the above basic subwoofer sealed enclosure, various enclosure modifications have been developed. Some utilize open tuned ports, but those can suffer from noise issues due to air turbulence at low frequencies. Others use passive radiators that, while effective in radiating the rear wave of the acoustic traducer, involve a large moving mass that can lead to excessive enclosure vibration.

With some conventional subwoofers, the reaction movement of the enclosure to the moving passive and woofer mass can cause significant enclosure radiation. This enclosure radiation is far from linear or controlled in amplitude, as it is subject to the resonance of the enclosure mass to such uncontrollable parameters as the floor stiffness as well as movement of enclosure walls caused by a lack of perfect stiffness of the enclosure walls.

As a result such enclosure radiation can represent a large added distortion to the sound field emitted by a conventional subwoofer. This distortion can be far more objectionable because, as a percentage, such distortion is generally independent of the sound level produced by the subwoofer. Unlike driver or amplifier distortion that starts at very low levels when the reproduced sound level is moderate, enclosure radiation distortion as a percentage of the reproduced sound field will be generally constant with any sound level reproduced. With many reproduced program material, the enclosure radiation distortion will far exceed the distortion of the woofer or amplifier.

BRIEF DESCRIPTION OF THE DRAWING

FIG. 5 is an equation defining a system coupling coefficient.

FIG. 6 is an equation defining an area coefficient.

FIG. 7 is an equation defining a mass coefficient.

DETAILED DESCRIPTION

Figure 1:
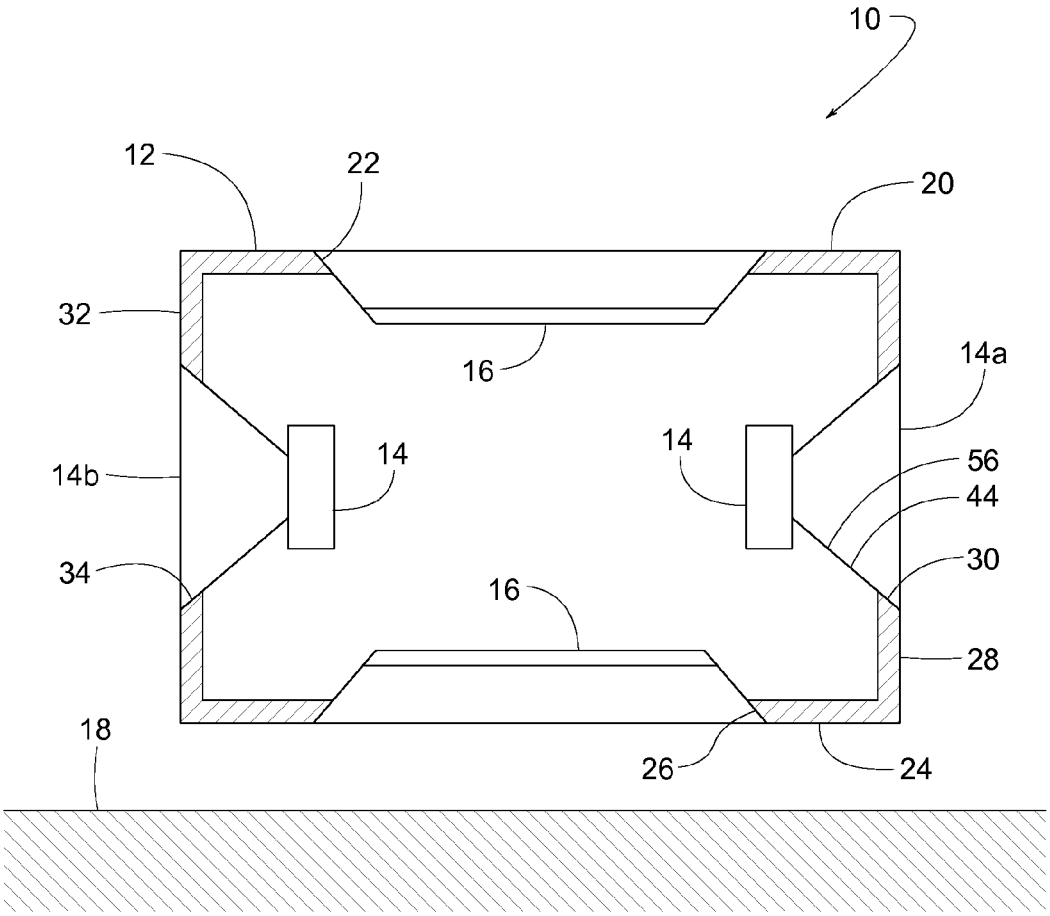
FIG. 1 is a schematic cross-sectional front view of one example of a loudspeaker system constructed in accordance with the teaching disclosed herein.

FIGS. 1-4 show a loudspeaker system 10 in the form of a balanced force subwoofer designed to effectively couple very low frequencies into the listening environment with low enclosure vibration and good efficiency. In some examples, speaker system 10 comprises an enclosure 12, at least two acoustic transducers 14 (e.g., a driver 14*a* and an opposite driver 14*b*), and at least two passive radiators 16 (e.g., a passive radiator 16*a* and an opposite passive radiator 16*b*).

In the illustrated example, enclosure 12 is a relatively rigid cuboid or box-like structure comprising a first panel 20 with a first opening 22 having a first area (i.e., the first area is the open cross-sectional area of first opening 22), a first opposite panel 24 with a first opposite opening 26 having a first opposite area, a second panel 28 with a second opening 30 having a second area, a second opposite panel 32 with a second opposite opening 34 having a second opposite area, a third panel 36, and a third opposite panel 38.

Figure 2:
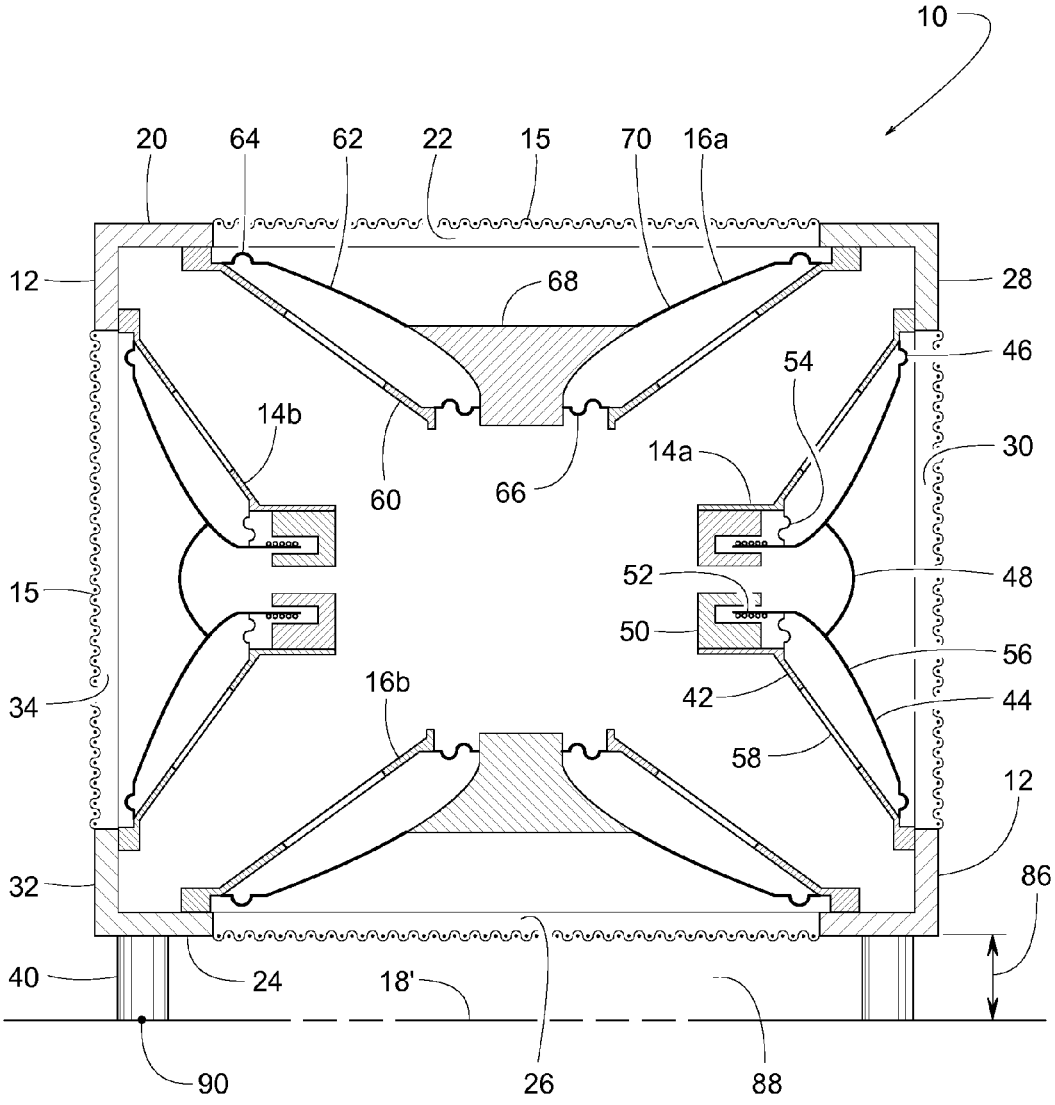
FIG. 2 is a more detailed cross-sectional front view of the loudspeaker system shown in FIG. 1.
Figure 3:
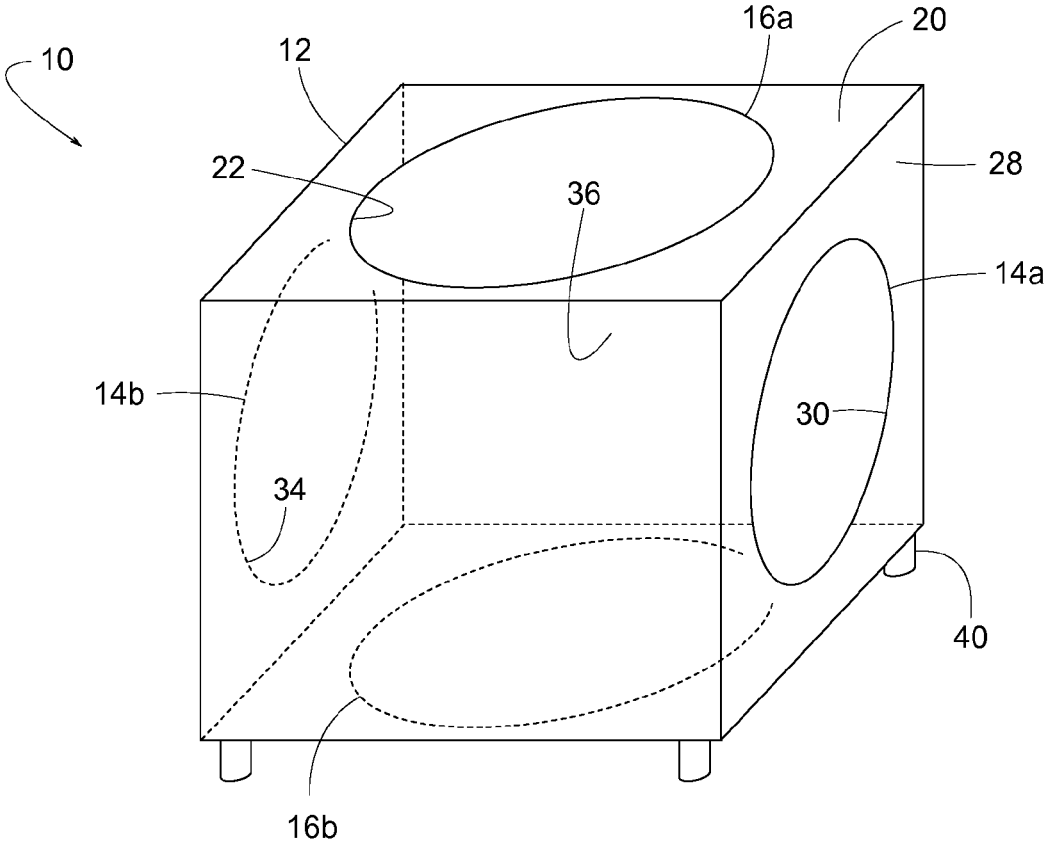
FIG. 3 is a perspective view of the loudspeaker system shown in FIG. 2.
Figure 4:
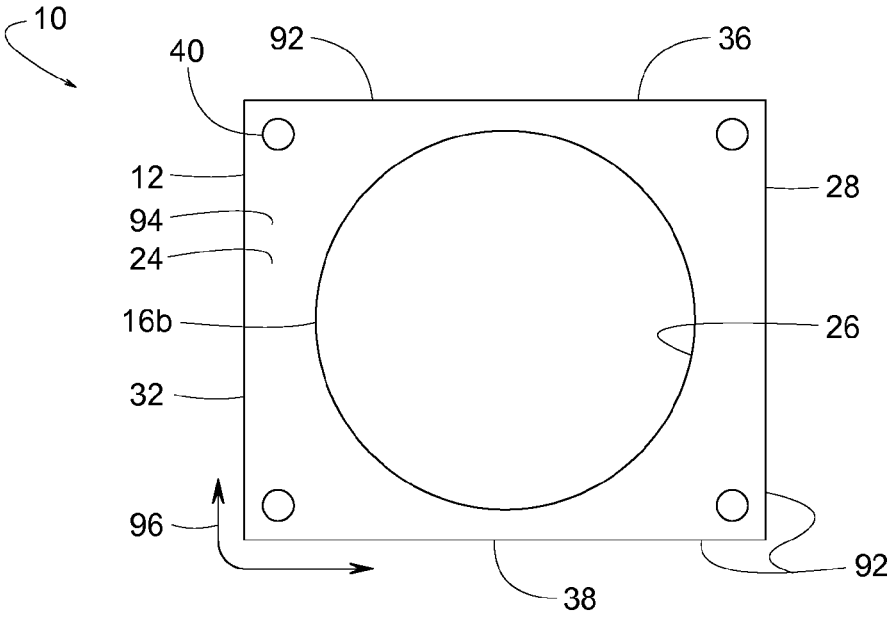
FIG. 4 is a bottom view of FIG. 3.

Although enclosure 12 can be in any spatial orientation, when enclosure 12 includes downward protruding spacers 40 (e.g., legs) and is oriented as shown in FIGS. 2 and 3, first panel 20 is then referred to as upper panel 20, first opening 22 is referred to as upper opening 22, the first area of upper opening 22 is referred to as an upper area, first opposite panel 24 is referred to as bottom panel 24, first opposite opening 26 is referred to as lower opening 26, the first opposite area of lower opening 26 is referred to as a lower area, second panel 28 is referred to as right panel 28, second opening 30 is referred to as right opening 30, the second area of right opening 30 is referred to as a right area, second opposite panel 32 is referred to as left panel 32, second opposite opening 34 is referred to as left opening 34, second opposite area of left opening 34 is referred to as a left area, third panel 36 is referred to as front panel 36, and third opposite panel 38 is referred to as rear panel 38. Some examples of enclosure 12 include inconsequential dust covers 15 covering openings 22, 26, 30 and/or 34. Dust covers 15 are made of a screen or porous fabric material.

In some examples, each acoustic transducer 14 is of a conventional construction, wherein each acoustic transducer 14 comprises a rigid frame 42 attached to enclosure 12, a cone 44, a flexible surround 46 connecting an outer periphery of cone 44 to frame 42, a dust cap 48, a magnet 50 attached to frame 42, a voice coil 52 extending from cone 44 and being in electromagnetic interaction with magnet 50, and a flexible spider 54 extending radially between voice coil 52 and frame 42. The moving portions of acoustic transducer 14 is referred to as an active diaphragm 56, which in some examples includes cone 44, surround 46, spider 54, dust cap 48 and voice coil 52. In some examples, frame 42 has one or more open areas 58 (air passageways) so that frame 42 provides diaphragm 56 with freedom to readily vibrate.

In some examples, each passive radiator 16 comprises a rigid frame 60 attached to enclosure 12, a cone 62, a flexible surround 64 connecting an outer periphery of cone 62 to frame 60, and a flexible spider 66 extending radially inward from frame 60 to provide cone 62 with some radial support. In some examples, a central mass 68 is attached to cone 62 and/or to some other moving portion of passive radiator 16 to provide passive radiator 16 with a desired passive radiator mass. Central mass 68 can be of any reasonable shape and material. Example materials of mass 68 include, but are not limited to, plastic, rubber, metal, etc. In some examples, passive radiator 16 does not include a voice coil and a magnet but instead is driven by changing air pressure within enclosure 12, wherein the air pressure is produced by movements of the acoustic transducer's diaphragm 56. The moving portions of passive radiator 16 is referred to as a passive diaphragm 70, which in some examples includes cone 62, surround 64, spider 66, and central mass 68.

As mentioned earlier, enclosure 12 can be in any spatial orientation. In some example orientations, each of the two acoustic transducers 14 and each of the two passive radiators 16 point in a horizontally outward direction. In examples where enclosure 12 includes downward protruding spacers 40 (e.g., legs) and is oriented with opposite passive radiator 16*b* facing downward, as shown in FIGS. 1-4, driver 14*a* is then referred to as right driver 14*a*, opposite driver 14*b* is referred to as left driver 14*b*, passive radiator 16*a* is referred to as upper passive radiator 16*a*, and opposite passive radiator 16*b* is referred to as lower passive radiator 16*b*. Regardless of the enclosure's orientation, the opposite facing acoustic transducers 14 effectively cancel out transducer cone mass induced vibration in enclosure 12.

While creating the illustrated arrangement of opposing drivers 14 and opposing passive radiators 16 is somewhat of a balancing act, rather than simply optimizing some theoretical balance point, it has been discovered that strategically chosen values of certain mass relationships, area relationships, and/or SCC (a system coupling coefficient 72), provides a sweet spot of performance. Such a sweet spot is defined by at least one of the relationships shown in FIGS. 5-7. To apply the relationships of FIGS. 5-7, certain variables and other values need to be defined (or understood with reference to Thiele/Small abbreviations and nomenclature known by those of ordinary skill in the art).

Specifically, "Mpt" refers to a cumulative passive radiator mass 74 or the total mass of the moving parts of passive radiators 16. In examples where enclosure 12 has two passive radiators 16, Mpt is the moving mass of both of them, not just one. The term, "$Mpt^2$" represents Mpt squared. The term, "Mmd" refers to a cumulative active radiator mass 76 or the total mass of the moving parts of drivers 14. The term, "Me" refers to the total enclosure mass 78 of enclosure 12. More specifically, "Me" equals the total mass of speaker system 10 minus a combination of the cumulative active radiator mass 76 and the cumulative passive radiator mass 74. The term, "$Me^2$" represents Me squared. A mass ratio 80 is defined as enclosure mass 78 squared ($Me^2$) divided by cumulative passive radiator mass 74 squared ($Mpt^2$).

The term, "Apt" refers to a cumulative passive radiation area 82, e.g., the cumulative cross-sectional area of opening 22 plus opening 26. The term, "Sdt" refers to a cumulative driver radiation area 84, e.g., the cumulative cross-sectional area of opening 30 plus opening 34. The term, "Aa" refers to a floor coupling area 85, which equals a vertical spaced apart distance 86 across a gap 88 between bottom panel 24 and a supporting surface 18 (e.g., floor, shelf, tabletop, etc.) or an imaginary plane 18' if speaker system 10 is not yet set upon an actual surface. Imaginary plane 18' is defined as being parallel to bottom panel 24 and intersecting a lowermost point 90 of spacer 40. Bottom panel 24 has an outer periphery 92 that defines a footprint 94 of bottom panel 24, and total peripheral length 96 is the circumscribed distance around the bottom panel's outer periphery 92.

A radiation factor 98 refers to cube root of cumulative passive radiation area 82 times cumulative driver radiation area 84 divided by floor coupling area 85. A mass radiation value 100 refers to the square root of mass ratio 80 times radiation factor 98. A reciprocal of mass radiation value 102 is equal to one divided by mass radiation value 100. A deviation from unity 104 refers to one minus the reciprocal of the mass radiation value 102. A sound transmission ratio 106 is defined herein as being equal to a predetermined density of air 110 divided by a predetermined speed of sound 108, wherein the predetermined speed of sound 108 is equal to 340 meters/second and the predetermined density of air 110 is equal to 1,184 grams/cubic-meter.

System coupling coefficient 72 (SCC) is equal to the deviation from unity 104 times the sound transmission ratio 106, wherein the enclosure mass 78 (Me) is in units of kilograms, the cumulative passive radiator mass 74 (Mpt) is in units of kilograms, the cumulative passive radiation area 82 (Apt) is in units of square-millimeters, the floor coupling area 85 (Aa) is in units of square-millimeters, and the cumulative driver radiation area 84 (Sdt) is in units of square-millimeters. In some examples, the system coupling coefficient 72 (SCC) is within a range of 3.2 to 3.6.

Arranging drivers and passive radiators within a enclosure, as disclosed herein, and limiting such a system to an SCC range of 3.2 to 3.6 results in system 10 being vibrationally balanced on all axes while still efficiently coupling low frequency energy sideways into the listening room and/or downward onto the room's floor. The vibrationally balanced system eliminates or at least minimizes the enclosure's vibration, and thus virtually eliminates enclosure radiation distortion. In some examples, minimizing the enclosure's reaction movement by balancing acceleration forces of both drivers 14 and passive radiators 16 results in losses of less than 0.5% for drivers 14 and less than 2.0% for passive radiators 16. The reduced distortion provides the listener with high sound quality while eliminating or minimizing what is sometimes described as, "muddy," "boomy," or "lacking in speed."

FIGS. 6 and 7 show additional or alternative means for readily achieving a balanced speaker system (e.g., speaker system 10) operating within the previously mentioned sweet spot, which results in the aforementioned benefits. FIG. 6, for example, shows the sweet spot is achieved when system 10 has an area coefficient 112 (AC) being within a range of 1.2 and 1.7, wherein area coefficient 112 is a dimensionless number. Area coefficient 112 is defined herein as being a numerator 114 divided by a denominator 116. Numerator 114 is equal to the cumulative passive radiation area 82 (Apt) multiplied by floor coupling area 85 (Aa). Denominator 116 equals cumulative driver radiation area 84 squared ($Sdt^2$). When all of the area values are in the same units (e.g., millimeters for Apt, Aa and Sdt), the units cancel to render area coefficient 112 a dimensionless number.

In the example of FIG. 7, the sweet spot is achieved when a mass coefficient 118 (MC) is within a predetermined range. Mass coefficient 118 defined herein as being a numerator 120 divided by a denominator 122. In this case, numerator 120 is equal to enclosure mass 78 (Me) in units of kilograms, and denominator 122 equals cumulative active radiator mass 76 (Mmd) in units of kilograms multiplied by cumulative passive radiator mass 74 (Mpt) in units of kilograms. The sweet spot is achieved when mass coefficient 118 is between 26 and 29.

In some examples, Me=35.4 Kg, Mpt=3.68 Kg, Apt=$1.67\times10^5$ $mm^2$, Sdt=$8.82\times10^4$ $mm^2$, Aa=$6.23\times10^4$ $mm^2$, p=1,275 $g/m^3$, c=343 m/sec, and Mmd=0.354 Kg. In smaller examples of speaker system 10, Me=14.9 Kg, Mpt=3.04 Kg, Apt=$5.8\times10^4$ $mm^2$, Sdt=$4.28\times10^4$ $mm^2$, Aa=$4.75\times10^4$ $mm^2$, p=1,275 $g/m^3$, c=343 m/sec, and Mmd=0.179 Kg.

In some examples, one passive radiator faces up, and one passive radiator faces down toward a floor. The passive radiators are substantially equivalent with each having a rather a large area and high mass. The passive radiator facing down effectively couples acoustic energy at very low frequencies onto the floor. This large high mass, bottom mounted, passive radiator will produce large amounts of enclosure vibration and so to cancel this vibration a second passive radiator of substantially the same mass and size is placed on the enclosure top surface. The resulting system will be vibrationally balanced on all axes while simultaneously effectively coupling low frequency energy onto the floor of the listening room with good efficiency.

Although the invention is described with respect to a preferred embodiment, modifications thereto will be apparent to those of ordinary skill in the art. The scope of the invention, therefore, is to be determined by reference to the following claims:

The invention claimed is:

1. A loudspeaker system for having a total mass, the loudspeaker system comprising:

a first panel, the first panel defining a first opening, the first opening having a first area;

a first opposite panel underneath the first panel and being substantially parallel to the first panel, the first opposite panel defining a first opposite opening, the first opposite opening having a first opposite area, the first area and the first opposite area providing a cumulative passive radiation area;

a second panel extending between the first panel and the first opposite panel, the second panel defining a second opening, the second opening having a second area;

a second opposite panel extending between the first panel and the first opposite panel, the second opposite panel being substantially parallel to the second panel and being substantially perpendicular to both the first panel and the first opposite panel, the second opposite panel defining a second opposite opening, the second opposite opening having a second opposite area, wherein the second area and the second opposite area provides a cumulative driver radiation area;

a third panel extending between the first panel and the first opposite panel, the third panel further extending between the second panel and the second opposite panel;

a third opposite panel spaced apart from the third panel, the third opposite panel extending between the first panel and the first opposite panel, the third opposite panel further extending between the second panel and the second opposite panel;

an enclosure being comprised of the first panel, the first opposite panel, the second panel, the second opposite panel, the third panel and the third opposite panel;

a driver at the second opening of the second panel;

an opposite driver at the second opposite opening of the second opposite panel, each of the driver and the opposite driver comprising a magnet voice coil and an active diaphragm with a voice coil, the active diaphragm being driven to move relative to the enclosure in response to an electromagnetic interaction between the magnet and the voice coil, the magnet being substantially fixed relative to the enclosure, the active diaphragm of the driver and the active diaphragm of the opposite driver providing a cumulative active radiator mass;

a passive radiator at the first opening of the first panel; and an opposite passive radiator at the first opposite opening of the first opposite panel, each of the passive radiator and the opposite passive radiator comprising a passive diaphragm that is driven pneumatically in reaction to movement of the driver and the opposite driver, the passive diaphragm of the passive radiator and the passive diaphragm of the opposite passive radiator providing a cumulative passive radiator mass, the enclosure having an enclosure mass equal to the total mass of the speaker system minus a combination of both the cumulative active radiator mass and the cumulative passive radiator mass, the driver being substantially equal to the opposite driver, the passive radiator being substantially equal to the opposite passive radiator, and the cumulative passive radiator mass being at least three times greater than the cumulative active radiator mass.

2. The loudspeaker system of claim 1, wherein each of the first area and the first opposite area is greater than each of the second area and the second opposite area.

3. The loudspeaker system of claim 1, wherein the loudspeaker system has a mass coefficient defined as a numerator divided by a denominator, wherein the numerator is equal to the enclosure mass in units of kilograms, the denominator equals the cumulative active radiator mass in units of kilograms multiplied by the cumulative passive radiator mass in units of kilograms, and the mass coefficient is between 26 and 29.

4. The loudspeaker system of claim 1, wherein the active diaphragm and the passive diaphragm are more flexible than the first panel, the first opposite panel, the second panel and the second opposite panel.

5. A loudspeaker system for use above a supporting surface, the loudspeaker system having a total mass, comprising:

a top panel, the top panel defining an upper opening, the upper opening having an upper area;

a bottom panel underneath the top panel and being substantially parallel to the top panel, the bottom panel defining a lower opening, the lower opening having a lower area, the upper area and the lower area providing a cumulative passive radiation area, the outer periphery of the lower panel having a total peripheral length, the bottom panel having a footprint defined by an outer periphery of the lower panel, a right panel extending vertically between the top panel and the bottom panel, the right panel defining a right opening, the right opening having a right area;

a left panel extending vertically between the top panel and the bottom panel, the left panel being substantially parallel to the right panel and being substantially perpendicular to both the top panel and the bottom panel, the left panel defining a left opening, the left opening having a left area, wherein the right area and the left area provides a cumulative driver radiation area;

a front panel extending between the top panel and the bottom panel, the front panel further extending between the right panel and the left panel;

a rear panel spaced apart from the front panel, the rear panel extending between the top panel and the bottom panel, the rear panel further extending between the right panel and the left panel;

an enclosure being comprised of the top panel, the bottom panel, the right panel, the left panel, the front panel and the rear panel;

a spacer extending downward from the enclosure to a lowermost point of the spacer, wherein the lowermost point is on an imaginary plane lying substantially parallel to the bottom panel with a gap defined by a vertical spaced apart distance between the bottom panel and the imaginary plane;

a floor coupling area defined as the vertical spaced apart distance times the total peripheral length of the outer periphery of the lower panel;

a right driver at the right opening of the right panel;

a left driver at the left opening of the left panel, each of the right driver and the left driver comprising a magnet and an active diaphragm with a voice coil, the active diaphragm being driven to move relative to the enclosure in response to an electromagnetic interaction between the magnet and the voice coil, the magnet being substantially fixed relative to the enclosure, the active diaphragm of the right driver and the active diaphragm of the left driver providing a cumulative active radiator mass;

an upper passive radiator at the upper opening of the top panel; and a lower passive radiator at the lower opening of the bottom panel, each of the upper passive radiator and the lower passive radiator comprising a passive diaphragm that is driven pneumatically in reaction to movement of the right driver and the left driver, the passive diaphragm of the upper passive radiator and the passive diaphragm of the lower passive radiator providing a cumulative passive radiator mass, the enclosure having an enclosure mass equal to the total mass of the speaker system minus a combination of both the cumulative active radiator mass and the cumulative passive radiator mass.

6. The loudspeaker system of claim 5, wherein the loudspeaker system has an area coefficient defined as a numerator divided by a denominator, wherein the numerator is equal to the cumulative passive radiation area multiplied by the floor coupling area, the denominator equals the cumulative driver radiation area squared, and the area coefficient is a dimensionless number between 1.2 and 1.7.

7. The loudspeaker system of claim 5, wherein the right driver is substantially equal to the left driver, the upper passive radiator is substantially equal to the lower passive radiator, and each of the upper area and the lower area is greater than each of the right area and the left area.

8. The loudspeaker system of claim 5, wherein the cumulative passive radiator mass is at least three times greater than the cumulative active radiator mass.

9. The loudspeaker system of claim 5, wherein the loudspeaker system has a mass coefficient defined as a numerator divided by a denominator, wherein the numerator is equal to the enclosure mass in units of kilograms, the denominator equals the cumulative active radiator mass in units of kilograms multiplied by the cumulative passive radiator mass in units of kilograms, and the mass coefficient is between 26 and 29.

10. The loudspeaker system of claim 5, wherein the active diaphragm and the passive diaphragm are more flexible than the top panel, the bottom panel, the right panel and the left panel.

11. A loudspeaker system for use above a supporting surface, the loudspeaker system having a total mass, comprising:

a top panel, the top panel defining an upper opening, the upper opening having an upper area;

a bottom panel underneath the top panel and being substantially parallel to the top panel, the bottom panel defining a lower opening, the lower opening having a lower area, the upper area and the lower area providing a cumulative passive radiation area, the outer periphery of the lower panel having a total peripheral length, the bottom panel having a footprint defined by an outer periphery of the lower panel, a right panel extending vertically between the top panel and the bottom panel, the right panel defining a right opening, the right opening having a right area;

a left panel extending vertically between the top panel and the bottom panel, the left panel being substantially parallel to the right panel and being substantially perpendicular to both the top panel and the bottom panel, the left panel defining a left opening, the left opening having a left area, wherein the right area and the left area provides a cumulative driver radiation area;

a front panel extending between the top panel and the bottom panel, the front panel further extending between the right panel and the left panel;

a rear panel spaced apart from the front panel, the rear panel extending between the top panel and the bottom panel, the rear panel further extending between the right panel and the left panel;

an enclosure being comprised of the top panel, the bottom panel, the right panel, the left panel, the front panel and the rear panel;

a spacer extending downward from the enclosure to a lowermost point of the spacer, wherein the lowermost point is on an imaginary plane lying substantially parallel to the bottom panel with a gap defined by a vertical spaced apart distance between the bottom panel and the imaginary plane;

a floor coupling area defined as the vertical spaced apart distance times the total peripheral length of the outer periphery of the lower panel;

a right driver at the right opening of the right panel;

a left driver at the left opening of the left panel, each of the right driver and the left driver comprising a magnet and an active diaphragm with a voice coil, the active diaphragm being driven to move relative to the enclosure in response to an electromagnetic interaction between the magnet and the voice coil, the magnet being substantially fixed relative to the enclosure, the active diaphragm of the right driver and the active diaphragm of the left driver providing a cumulative active radiator mass;

an upper passive radiator at the upper opening of the top panel;

a lower passive radiator at the lower opening of the bottom panel, each of the upper passive radiator and the lower passive radiator comprising a passive diaphragm that is driven pneumatically in reaction to movement of the right driver and the left driver, the passive diaphragm of the upper passive radiator and the passive diaphragm of the lower passive radiator providing a cumulative passive radiator mass, the enclosure having an enclosure mass equal to the total mass of the speaker system minus a combination of both the cumulative active radiator mass and the cumulative passive radiator mass;

a mass ratio being defined as the enclosure mass squared divided by the cumulative passive radiator mass squared;

a radiation factor being defined as the cube root of the cumulative driver radiation area times the cumulative passive radiation area divided by the floor coupling area;

a mass radiation value being defined as the square root of the mass ratio times the radiation factor;

a deviation from unity being defined as one minus a reciprocal of the mass radiation value;

a sound transmission ratio being defined as a predetermined speed of sound divided by a predetermined density of air; and a system coupling coefficient being defined as the deviation from unity times the sound transmission ratio, wherein the enclosure mass is in units of kilograms, the cumulative passive radiator mass is in units of kilograms, the cumulative passive radiation area is in units of square-millimeters, the floor coupling area is in units of square-millimeters, the cumulative driver radiation area is in units of square-millimeters, the predetermined density of air is 1,184 and is in units of grams/cubic-meter, the predetermined speed of sound is 340 and is in units of meters/second, and the system coupling coefficient is within a range of 3.2 to 3.6.

12. The loudspeaker system of claim 11, wherein the right driver is substantially equal to the left driver, the upper passive radiator is substantially equal to the lower passive radiator, and each of the upper area and the lower area is greater than each of the right area and the left area.

13. The loudspeaker system of claim 11, wherein the cumulative passive radiator mass is at least three times greater than the cumulative active radiator mass.

14. The loudspeaker system of claim 11, wherein the loudspeaker system has an area coefficient defined as a numerator divided by a denominator, wherein the numerator is equal to the cumulative passive radiation area multiplied by the floor coupling area, the denominator equals the cumulative driver radiation area squared, and the area coefficient is a dimensionless number between 1.2 and 1.7.

15. The loudspeaker system of claim 11, wherein the loudspeaker system has a mass coefficient defined as a numerator divided by a denominator, wherein the numerator is equal to the enclosure mass in units of kilograms, the denominator equals the cumulative active radiator mass in units of kilograms multiplied by the cumulative passive radiator mass in units of kilograms, and the mass coefficient is between 26 and 29.

16. The loudspeaker system of claim 11, wherein the active diaphragm and the passive diaphragm are more flexible than the top panel, the bottom panel, the right panel and the left panel.

* * * * *